US005184856A

United States Patent [19]

Waltz

[11] Patent Number: 5,184,856

[45] Date of Patent: Feb. 9, 1993

[54] DOOR LOCK ARMATURE ASSEMBLY

[75] Inventor: Kevin P. Waltz, Indianapolis, Ind.

[73] Assignee: Von Duprin, Inc., Indianapolis, Ind.

[21] Appl. No.: 921,777

[22] Filed: Jul. 30, 1992

[51] Int. Cl.[5] ..... E05C 17/56

[52] U.S. Cl. ..... 292/251.5; 292/144

[58] Field of Search ..... 292/144, 251.5, DIG. 53

[56] References Cited

U.S. PATENT DOCUMENTS

| | | | |
|---|---|---|---|
| 4,981,312 | 1/1991 | Frolov | 292/251.5 |
| 4,986,581 | 1/1991 | Geringer et al. | 292/251.5 |
| 5,016,929 | 5/1991 | Frolov | 292/251.5 |
| 5,065,136 | 11/1991 | Frolov et al. | 292/251.5 |

*Primary Examiner*—Richard E. Moore

*Attorney, Agent, or Firm*—Robert F. Palermo; A. James Richardson

[57] ABSTRACT

An electromagnetic door lock assembly employs an electromagnet positioned in a frame adjacent to a door, and an adjustable armature assembly positioned in the door for interaction with the electromagnet. The armature assembly includes an armature plate having a pair of shear low-cost, replaceable elements that initially engage the electromagnet. A backing plate is situated adjacent to the armature plate, and a stem coupling the backing plate to the armature plate includes a spring biasing the backing plate and armature plate toward each other. A mounting portion for mounting the armature assembly to a door to be locked is provided with adjusting screws for adjustably positioning the backing plate at a fixed position with respect to the mounting portion so that the armature plate is positioned at a first position for optimum interaction with the electromagnet, the screws having elongated heads for maintaining the relative alignment between the armature plate and the mounting portion as the armature plate moves between the first position and a position contiguous to the electromagnet.

20 Claims, 2 Drawing Sheets

DOOR LOCK ARMATURE ASSEMBLY

BACKGROUND OF THE INVENTION

The present invention relates generally to electromagnetic door locking devices and more particularly to shear locks having improved features which ensure that the lock operates rapidly and positively during both locking and unlocking operations.

Various types of electromagnetic door locks are known. One type commonly referred to as a shear lock comprises an electromagnet mounted to or in a frame defining a doorway. An armature is movably mounted to travel with a door as the door moves in the doorway between an "open" and "closed" position. When the door is in the closed position, the armature is positioned in spaced relation from the electromagnet, but is mounted to or in the door such that when power is applied to the electromagnet the armature responds to the magnetic field and becomes engaged on an adjacent surface of the electromagnet.

Various styles and types of shoulder means such as ledges, tangs, and tabs have been employed to provide some physical interrelationship between the face of the electromagnet and the armature to enhance the lock's resistance to a shearing movement which would result from any attempt to open the door while power was applied to the electromagnet. It has been observed that such shoulder means exhibit increasing wear and potentially decreasing performance with time, thus mandating replacement of the shoulder elements exhibiting such wear. Where the shoulder elements are integral with the major elements of the electromagnetic lock, such replacement can be quite costly.

It would therefore be desirable to provide such shoulder means in the form of easily replaced, separate, low cost elements. Preferably, such replaceable elements are constructed to have material hardness less than the material hardness of the elements with which they cooperate to achieve the desired physical shear-inhibiting interrelationship. This selection of lesser material hardness results in reduced wear on the cooperating element thereby extending the life of the lock as a whole.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an electromagnetic door lock assembly which can be used in combination with an electromagnet mounted in a frame adjacent a door such that a shoulder interacts with an associated armature assembly to enhance resistance to shearing movement between the electromagnet and the armature assembly. The armature assembly is provided for positioning in the door for interaction with the electromagnet. The armature assembly includes an armature plate and a backing plate. The armature plate is biased away from the electromagnet. First and second shear elements are replaceably affixed to the armature plate to confront the shoulder.

The foregoing and other aspects will become apparent from the following detailed description o the invention when considered in conjunction with the accompanying drawing figures.

DETAILED DESCRIPTION

Figure 1:
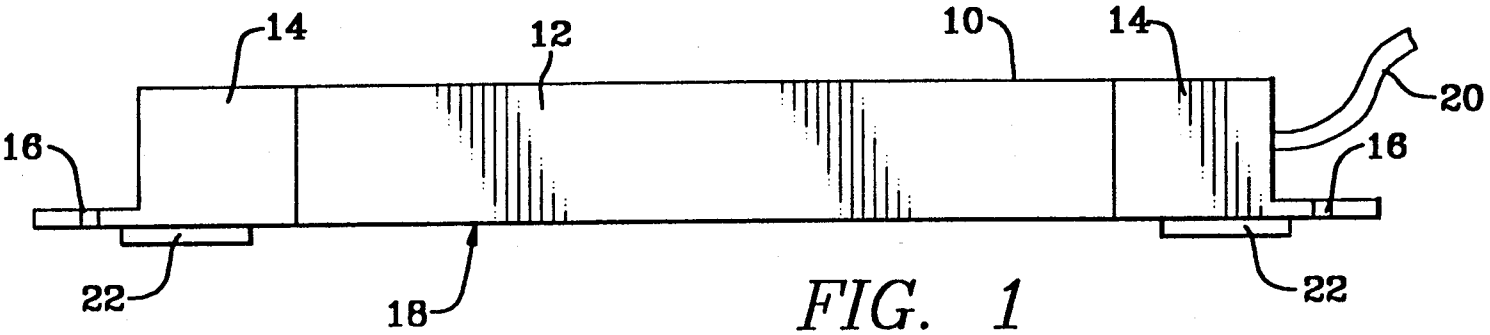
FIG. 1 is a side elevation of a typical electromagnet employed in a door lock assembly according to the present invention.
Figure 2:
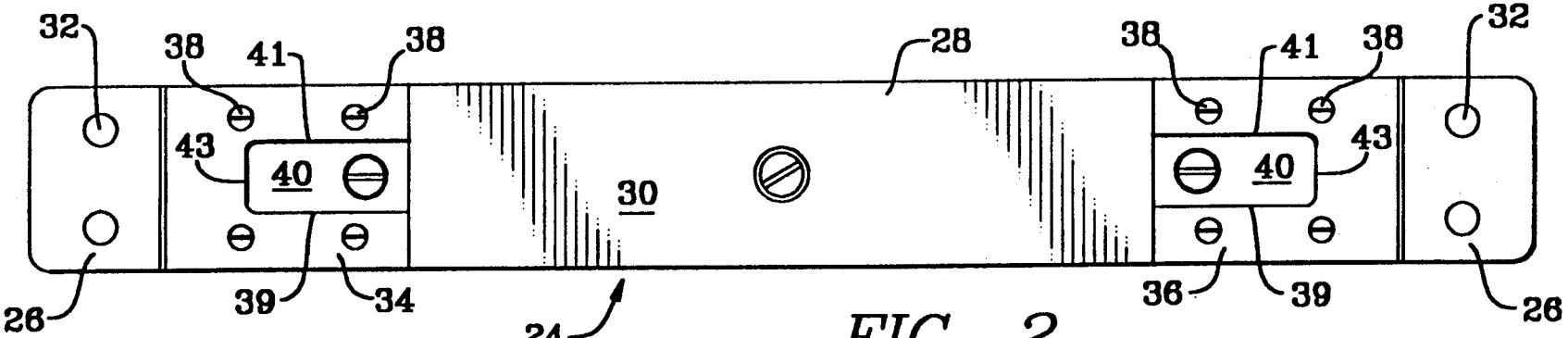
FIG. 2 is a plan view of an armature assembly designed for interaction with the electromagnet of FIG. 1.

An electromagnet 10 for use with an armature in a door lock in accordance with the present invention is shown in FIG. 1. The electromagnet 10 comprises a coil potted in a housing 12. The housing 12 includes mounting portions 14 at each end of the coil which are adapted to be secured to a door frame by screws or other similar fastening means passing through openings 16. The electromagnet includes a lower face 18 adapted to be confronted by a cooperating armature such as is shown in FIG. 2. The lower face 18 of the electromagnet 10 is contacted by the armature plate when power is applied to the coil through wire 20 from a power source, not shown. Shoulder means in the form of projections 22 are provided on the mounting portions 14 to interact with cooperating structure on the armature to enhance the lock's resistance to any applied shearing force.

An armature assembly 24 is shown in FIG. 2 to comprise a mounting portion 26 which receives an armature plate 28 having an upper surface 30 confronting and intended to contact surface 18 of the electromagnet 10. The mounting portion 26 is adapted to be secured to a door by screws or other similar fastening means passing through openings 32. The armature plate 28 is adapted to receive replaceable shear elements 34 and 36 which are affixed on the ends of the armature plate 28 by screws 38 or other similar fastening means to the mounting portions 14 of the electromagnet housing 12. The shear elements 34 and 36 are formed to include a central groove 40 adapted to receive the projection 22 from the confronting electromagnet mounting portion 14. The central groove 40 is defined by side ledge portions 39 and 41, and by end ledge portion 43. The end ledge portion 43 of both shear elements 34 and 36 are preferably dimensioned to physically contact at least one of the ends of projections 22 prior to and effectively preventing any contact between projections 22 and the armature plate 28.

Figure 3:
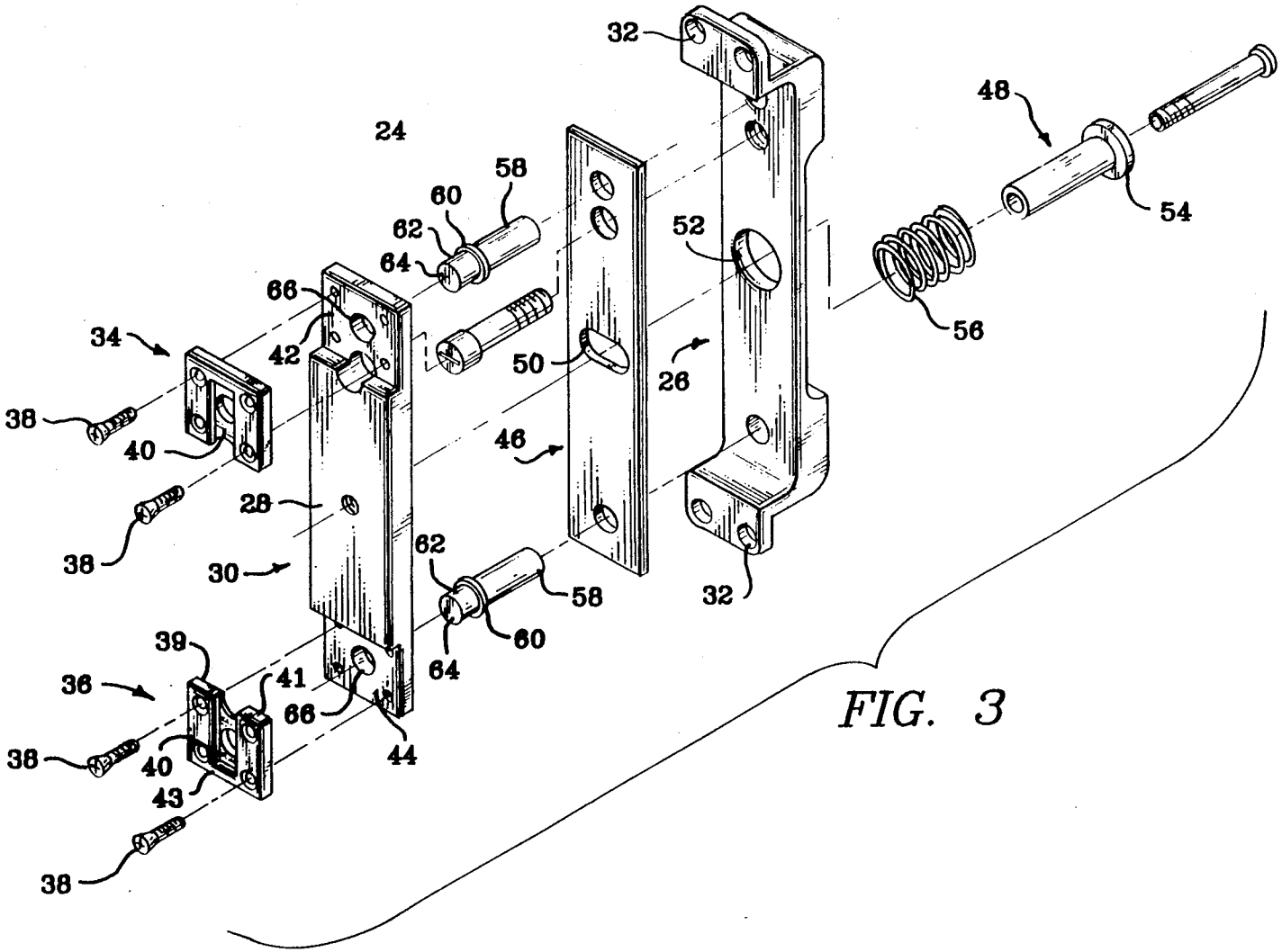
FIG. 3 is an exploded perspective view of the armature assembly shown in FIG. 2.

The armature assembly 24 is shown in more detail in FIG. 3 to include steps or recesses 42 and 44 at opposite ends of the armature plate 28 for receiving the shear elements 34 and 36 respectively. The shear elements 34 and 36 are connected to the armature plate 28 by threaded screws 38. When necessary, due to wear or damage, the threaded screws 38 can be temporarily removed, and the shear elements 34 replaced. This operation is relatively simple, and can be accomplished without further disassembly of the armature assembly 24 or removal of the door to which the armature assembly is mounted.

The armature plate 28 is coupled to a separate backing plate 46 by a stud or similar element 48 which is secured to the armature plate 28. The stud 48 projects through an opening 50 in backing plate 46 and through another opening 52 in mounting portion 26. The stud 48 includes an outwardly projecting flange 54 at a rear most end of the stud. A coil spring 56 surrounds the stud with one end of the spring contacting the flange 54 and the other end of the spring contacting a back surface of the backing plate 46. The spring 56 acts as a biasing means for biasing the flange 54 away from backing plate 46 which has the effect of biasing the backing plate 46 and armature plate 28 toward each other. In the presence of a magnetic field generated by the electromagnet 20, the armature plate 28 moves with respect to the backing plate 46 against the biasing force applied by the spring 56.

A pair of threaded studs 58 are provided which are adjustably engaged with the mounting portion 26. Each of the studs 58 includes an integral radial flange 60. Any outward adjustment of the studs 58 with respect to the mounting portion 26 causes the flanges 60 to move outward thereby displacing the armature plate 28 away from the mounting portion 26 and toward the electromagnet 10. Any outward adjustment of the rest position of the armature plate 28 by adjustment of the threaded studs 58 also causes the backing plate 46 to move outward since the backing plate 46 and armature plate 28 are biased toward each other by spring 56 as previously described. It will be noted that the biasing force against which the electromagnet 10 must act to attract the armature plate 28 is set by the spring constant of spring 56. The biasing force is independent of the adjustment of threaded studs which merely sets the original distance of separation between the electromagnet 10 and armature plate 28.

The movement of the armature plate 28 in response to an applied magnetic field is guided by means of openings 66 which surround the upper portion 62 of the threaded studs 58. The upper ends 64 of the studs 58 project through openings 66 in the shear elements 34 and 36, and are substantially coplanar with the surface 40 of the shear elements 34 in the absence of an applied magnetic field. Thus, the guiding function provided by the interaction between the openings 66 and the upper portions 62 operates over a range of movement about equal to the thickness of the armature plate 28.

Preferably, the shear elements 34 and 36 are fabricated from a material which is different from mounting portions 14 for the electromagnet 10. While the shear elements 34 and 36 could be constructed as integral stainless steel pieces, the preferred composition is sintered, powdered stainless steel. The shear elements 34 and 36 are preferably formed to have a hardness slightly less than the hardness of the projections 22 on the electromagnet mounting portion 14 The material forming the shear elements can also include self-lubricating characteristics and surface smoothness characteristics designed to maximize the service life of the inserts. This construction ensures that any contact between the shear elements and the shoulder means 22 will result in differential wear upon the shear elements, which can be economically and easily replaced at the site. Because of their attachment by threaded screws, the shear elements are more readily replaceable than either the electromagnet mounting portion or an entire unitary armature plate of the type typically used in the prior art. The use of an armature assembly as described and shown reduces maintenance costs and increases the useful service life of any electromagnetic lock system in which they are employed.

Although the invention has been described in detail with reference to the illustrated preferred embodiments, variations and modifications exist within the scope and spirit of the invention as described and as defined in the following claims.

What is claimed is:

1. An electromagnetic door lock assembly comprising:

an electromagnet;

means for mounting the electromagnet in a frame adjacent to a door, the mounting means including shoulder means for interacting with an associated armature means to enhance resistance to shearing movement between the electromagnet and armature;

the armature means provided for positioning in the door for interaction with the electromagnet, the armature means including an armature plate, a backing plate, and biasing means for biasing the armature plate away from the electromagnet; and first and second shear elements replaceably affixed to the armature plate to confront the shoulder means.

2. The door lock assembly of claim 1, wherein the first and second shear elements are composed of a material different from that forming said shoulder means.

3. The door lock assembly of claim 1, wherein the first and second shear elements are constructed to have material hardness less than material hardness of the electromagnet to reduce wear on the electromagnet resulting from sliding contact with the replaceable first and second shear elements.

4. The door lock assembly of claim 1, wherein the first and second shear elements are attached at opposite ends of the armature plate by a plurality of threaded screws.

5. The door lock assembly of claim 4, wherein the first and second shear elements are formed to include channel means for enveloping said shoulder means extending toward the armature plate from the electromagnet to inhibit relative lateral movement of the armature means and electromagnet when the electromagnet is energized and the armature means and electromagnet are contiguous to each other.

6. The door lock assembly of claim 1, wherein the armature means further comprises coupling means for coupling the backing plate to the armature plate, said biasing means biasing the backing plate and armature plate toward each other.

7. The door lock assembly of claim 6, wherein the coupling means comprises a first element fixed to the armature plate for movement therewith, the backing plate being movable with respect to the first element and said biasing means acting between the first element and the backing plate to bias the backing plate and armature plate toward each other.

8. The door lock assembly of claim 7, wherein the backing plate comprises a first surface confronting the back surface of the armature plate and a second surface opposite from the first surface, said first element projects through an opening in the backing plate, and said biasing means contacts the backing plate second surface.

9. The door lock assembly of claim 8, wherein said first element includes an enlarged end remote from the backing plate, said biasing means comprising a spring positioned between the enlarged end and the backing plate for applying a biasing force independent of the relative position between the backing plate and the mounting portion.

10. The door lock assembly of claim 6, wherein the armature means further comprises a mounting portion for mounting the armature means to said door to be locked, adjusting means for adjustably positioning the backing plate at a fixed position with respect to the mounting portion so that a front surface of the armature plate is positioned at a first position for optimum interaction with the electromagnet, and alignment means for maintaining the relative alignment between the armature plate and the mounting portion as the armature plate moves between said first position and a position contacting the electromagnet.

11. The door lock assembly of claim 10, wherein the mounting portion comprises a central channel receiving the armature plate and backing plate and integral mounting flanges at the ends of the central channel for mounting the armature means to said door to be locked.

12. The door lock assembly of claim 10, wherein the adjusting means comprises threaded elements engaging the backing plate and rotatable with respect to the mounting portion for adjusting the displacement of the backing plate with respect to the mounting portion.

13. The door lock assembly of claim 10, wherein the armature means further comprises spacer means for spacing the armature plate from the backing place by a selected minimum distance to prevent contact between the armature plate and backing plate upon return of the armature plate to the first position.

14. The door lock assembly of claim 1, wherein the replaceable first and second shear elements include a front surface having channel means for receiving said shoulder means extending toward the armature plate from the electromagnet mounting means to inhibit relative lateral movement of the armature means and electromagnet when the electromagnet is energized.

15. The door lock assembly of claim 14, wherein the channel means is defined by side ledges located on opposite sides of each shear element, and an end ledge located on each shear element and situated over the end of the armature plate for interaction with said shoulder means.

16. An adjustable armature assembly for use in an electromagnetic door lock comprising:

armature plate means having a front surface confronting an electromagnet for magnetically interacting therewith and having a back surface opposite the front surface, the armature plate means being configured to accommodate removable shear elements;

a backing plate situated adjacent to the back surface of the armature plate;

coupling means for coupling the backing plate to the armature plate means including biasing means for biasing the backing plate and armature plate means toward each other;

a mounting unit for mounting the armature assembly to a door to be locked;

adjustable elements engaging the mounting unit and having upper portions projecting through openings in the backing plate and armature plate means, the upper portions positioned substantially coplanar with the armature plate means front surface, the adjustable elements adjustably positioning the backing plate at a selected position with respect to the mounting portion so that the front surface of the armature plate means is positioned at a first position spaced from the electromagnet, the upper portions of the adjustable elements maintaining the relative alignment between the armature plate means and the mounting portion as the armature plate means moves between said first position and a position contiguous to the electromagnet; and first and second removable shear elements positioned on said armature plate means to contact a projecting surface adjacent to the electromagnet as the armature plate means is moved toward the electromagnet, the removable shear elements being constructed from material different from the projecting surfaces adjacent the electromagnet.

17. The armature assembly of claim 16, wherein the removable shear elements fixed to the armature plate means are composed of a material which will result in differential wear occurring upon the shear elements rather than said shoulder means.

18. The armature assembly of claim 17, wherein the removable shear elements are composed of a material having a hardness less than the hardness of the shoulder means.

19. The armature assembly of claim 18, wherein the removable shear elements are composed of a sintered, powdered stainless steel.

20. An electromagnetic door lock assembly comprising:

an electromagnet;

mounting means for mounting the electromagnet to a frame adjacent to a door; and an armature plate positionable in the door, the armature plate having a front surface confronting the electromagnet and having a back surface opposite the front surface, the armature plate having end portions extending lengthwise beyond the lengthwise dimension of said electromagnet, the armature plate end portions including recesses in the front surface, and removable shear elements secured in the recesses to inhibit relative shearing movement of the armature plate and electromagnet, the removable shear elements being constructed from material having a hardness less than a hardness of the electromagnet.

* * * * *